United States Patent [19]

Strauss

[11] Patent Number: 4,547,696

[45] Date of Patent: Oct. 15, 1985

[54] TENSION MASK REGISTRATION AND SUPPORTING SYSTEM

[75] Inventor: Paul Strauss, Chicago, Ill.

[73] Assignee: Zenith Electronics Corporation, Glenview, Ill.

[21] Appl. No.: 572,088

[22] Filed: Jan. 18, 1984

[51] Int. Cl.[4] ..... H01J 29/02; H01J 29/07; H01J 29/86; B05D 5/06

[52] U.S. Cl. ..... 313/407; 313/477 R; 313/292; 427/68

[58] Field of Search ..... 313/402, 407, 408, 288, 313/292, 477; 445/37, 47; 220/2.1 A; 427/68, 64

[56] References Cited

U.S. PATENT DOCUMENTS

| | | | |
|---|---|---|---|
| 2,625,734 | 1/1953 | Lan | 29/25.13 |
| 2,961,560 | 11/1960 | Flyer | 313/408 X |
| 3,284,655 | 11/1966 | Oess | 313/286 |
| 3,894,321 | 7/1975 | Moore | 313/402 |

*Primary Examiner*—Palmer C. DeMeo
*Assistant Examiner*—Sandra L. O'Shea
*Attorney, Agent, or Firm*—Ralph E. Clarke, Jr.; Cornelius J. O'Connor

[57] ABSTRACT

A color tube comprises a panel having a patterned screen of phosphor deposits. The panel includes a registration affording arrangement defined by a first plurality of cavities each comprising an elongated, substantially radially aligned portion formed at a selected peripheral location upon the screen side of the panel. A frame dimensioned to enclose the screen comprises first and second spaced-apart surfaces and a registration affording arrangement defined by a second like plurality of cavities, each also comprising an elongated, substantially radially aligned portion formed at a selected peripheral location upon the frame's first surface. The pluralities of panel and frame cavities are arranged so that, collectively, the axes of the elongated portions of the panel cavities and of the frame cavities exhibit substantially the same radial geometry. A tensed foil color selection electrode having a pattern of apertures has a peripheral portion bonded to the frame's second surface. An indexing arrangement comprises a like plurality of spherical elements individually received between an assigned panel cavity and an adjacent, oppositely disposed confronting frame cavity, so that when the panel and frame cavities overlie, the spherical elements establish a precise repeatable registration between the frame and the panel, and thus between the foil apertures and the screen.

24 Claims, 5 Drawing Figures

TENSION MASK REGISTRATION AND SUPPORTING SYSTEM

CROSS-REFERENCE TO RELATED APPLICATIONS

This application is related to but in no way dependent upon copending applications Ser. Nos. 538,001 and 538,003, both filed Sept. 30, 1983; Ser. No. 572,089 filed Jan. 18, 1984; and Ser. Nos. 641,861 and 641,862, both filed Aug. 31, 1984.

BACKGROUND OF THE INVENTION

This invention relates in general to color cathode ray tubes, and to a novel color selection electrode apparatus and indexing arrangement for use in such a tube. Of equal significance, the invention is concerned with the use of such an apparatus for screening the target surface of a flat face panel.

In general, a color selection electrode or "shadow mask" is a device which is disposed adjacent the luminescent phosphor screen that forms the target electrode of a color cathode ray tube, to control the landing pattern of one or more electron beams as they are swept across the screen. The shadow mask achieves color selection by partially shadowing the surface of the screen from scanning electron beams, permitting access to selected elemental phosphor areas by those beams. The choice of a color selection electrode for use in color television cathode ray tubes is, by and large, a choice between a spherical or bi-radial electrode and a cylindrical electrode tensed upon a heavy frame—both types being supported within the tube envelope. The most common type of color selection electrode used in color television receivers today is the conventional curved type.

In color picture tubes utilizing a conventional shadow mask, there is a tendency on the part of the mask to "dome" (localized buckling) in those areas where a scene characterized by very high brightness is depicted. For example, in a scene where a high concentration of light is presented for an extended period of time, when the beams sweep that area of the screen the current in each beam peaks precipitously with an attendant localized heating of the mask. As a result of such a concentration of heat, that area of the mask expands and displaces itself from its original "cold" position to a position in which it does not effect proper masking of the writing electron beams. As a result, color purity is degraded. Moreover, because of its vulnerability to "doming", a conventional mask cannot accommodate the power density that a "doming-resistant" tensed mask can.

The general practice in cathode ray tubes manufactured for use in color television receivers is to position the mask at an assigned location, relative to the phosphor screen, by suspending it from three preselected points disposed about the periphery of the tube's face panel. This suspension accommodates overall thermal expansion of the mask by causing the mask to be displaced toward the screen from its original position by provision of bi-metallic support springs; however, such provision can not resolve the above-described localized "doming" problem caused by concentrated heating in localized areas of the mask.

Insofar as the use of a tensioned color selection electrode is concerned, the most common use of such an electrode has been in connection with the cylindrical faceplate CRT produced by one color television manufacturer. In that tube, the color selection electrode comprises a grid formed of a multitude of parallel conductors tensed across a spring frame suspended conventionally within the tube. This grid serves to mask the writing beams in such a fashion that they fall upon the desired light emitting phosphor.

In the afore-mentioned cylindrical faceplate tube, the mask supporting frame is mechanically stressed, as by compressing it, prior to attaching the shadow mask thereto. Upon release of the compression force, restoration forces in the frame establish tension in the mask.

An advantage of utilizing a tensed mask resides in the fact that the mask, while under tension, will not dome. The mask retains its desired configuration during normal operating conditions.

Under extreme tube operating conditions, however, electron bombardment of a tensed grid mask can cause a series of grids of the mask to relax and cause color impurities. A cathode ray tube utilizing a tensed mask of the type adverted to above, the Sony Trinitron, is described in U.S. Pat. No. 3,638,063.

The color television cathode ray tube in most common usage today employs a faceplate which approximates a section of a large radius sphere. The shadow mask in such a tube, of course, is contoured to match the faceplate. A trend today is toward a flatter faceplate which, in turn, calls for a flatter shadow mask. However, a flat mask is inherently less mechanically stable than a curved mask. Accordingly, to acquire stability, resort is had to a thicker mask, for example, one having a thickness in the order of 10 to 12 mils. This is approximately twice the thickness of a conventional curved mask. However, when one goes to a 10 to 12 mil mask the aperture etching process is much more difficult. Specifically, in order to prevent aperture limiting of the beam at the outer reaches of the mask, as would be encountered in a 90 degree tube, the apertures have to be etched at an angle to the plane of the mask, rather than etched substantially perpendicular to that plane as is the case for a conventional curved mask.

DISCUSSION OF OTHER PRIOR ART

An early example of a tensed shadow mask for use in a color television cathode ray tube is described in U.S. Pat. No. 2,625,734. The tensed mask described therein was created by resort to a process called "hot-blocking". The practice was to insert a flat mask between a pair of frames which loosely received the mask. A series of tapped screws joining the two frames served to captivate the mask when the screws were subsequently drawn-down. The loosely assembled frame and mask was then subjected to a heat cycle by positioning heated platens adjacent the mask to heat and thereby expand it. The frame, however, was kept at room temperature. When the mask attained a desired expansion, the frame screws were tightened to captivate the mask in its expanded state. The heating platens were then removed. Upon cooling down to room temperature, the mask was maintained under tension by the frame. The resultant assembly was then mounted inside the tube adjacent the phosphor screen.

U.S. Pat. No. 3,284,655—Oess is concerned with a direct viewing storage cathode ray tube employing a mesh storage target which is supported in a plane perpendicular to the axis of the tube. The mesh target comprises a storage surface capable of retaining a charge pattern which, in turn, control the passage therethrough of a stream of electrons. From a structural standpoint, it is proposed that the mesh storage screen be affixed (no details given) to a circumferential ring that is disposed across the open end of envelope member. One end of the ring is in contact with the edge of the envelope member which has a coating of glass frit applied thereon. The end wall of another envelope member, also coated with frit, is placed in contact with the other side of the ring so that the end walls of the envelope members now abut both sides of the ring. Thereafter this assembly is frit sealed to secure the ring and mesh target within the tube.

It is of particular significance that the electrode spanning the inside of the tube envelope is a mesh screen that is not said to be subject to tension forces. Moreover, the mesh screen is not a color selection electrode that serves to direct a writing beam to selected elemental areas of color phosphors. Finally, there is no criticality, perceived or discussed, as respects mesh target registration with the phosphor layer on the faceplate.

U.S. Pat. No. 2,813,213 describes a cathode ray tube which employs a switching grid mounted adjacent the phosphor screen to provide a post deflection beam deflecting force. Basically, it is proposed to employ a taut wire grid that is sealed in the tube envelope wall and which, in one embodiment, proposes the use of an external frame to relieve the tension forces applied by the taut grid to the glass wall of the tube. In another embodiment, which is not pictorially disclosed but simply textually referred to, an arrangement is proposed comprising a glass donut-shaped structure into which the grid wires are sealed. This donut assembly is then inserted between the faceplate of the tube and its conical section. Thereafter, the patent notes, after the tube is assembled, the phosphors may be deposited on the faceplate by conventional photographic processes. The application of elemental color phosphor areas to the faceplate of a tube is, in itself, a formidable task; how this could be achieved with a grid structure in situ across the faceplate is dismissed perfunctorily.

In U.S. Pat. No. 4,069,567, assigned to the assignee of the present invention, there is disclosed a method useful in the manufacture of a color cathode ray tube of the type having a phosphor screen and spaced therefrom a tensed color selection electrode. The method is a method of installing the electrode such that under normal tube operating conditions, the electrode is held by a holder in a hypertensed state and is thus capable of withstanding an unusually high electron beam bombardment before relaxing. In a preferred execution the method comprises selecting for the electrode a material which has a significantly higher coefficient of thermal expansion than that of the holder. The electrode and the holder are externally heated together, as by an oven, while the electrode is tensed. Simultaneously therewith, a selective auxiliary heating of the electrode is expected, as by passing an electrical current through the electrode, or by RF heating, such that the holder is heated to a predetermined first elevated temperature significantly greater than the first temperature, the holder and electrode thus being caused to thermally expand, but the electrode by a greater amount. The electrode is affixed to the holder. Finally, the electrode and holder are cooled to room temperature so as to hypertense the electrode due to the greater coefficient of thermal expansion and temperature fall of the electrode than the holder.

U.S. Pat. No. 4,100,451 to Palac, which is assigned to the assignee of the present invention, describes a system for suspending a non-self-rigid shadow mask a predetermined distance from a faceplate. Four suspension means provide for coupling and indexing the mask directly to corner portions of the faceplate. In one embodiment, the indexing means comprise legs having rounded portions which engage indexing cavities in the faceplate which may be in the form of V-grooves or slots. Another approach shows V-blocks at the four corners of the faceplate, each of which receives a clamp attached to the mask. Each clamp has a foot for mating with the V-block. The suspension and indexing means provide for the permanent mounting of the shadow mask in relation to the faceplate, as well as for the temporary mounting of the mask during the production screen processing. It is generally known in other contexts to use interrigistering parts using V-grooves in addressing parts and a captured ball.

U.S. Pat. No. 3,894,321 is directed to a method for processing a color cathode ray tube having a thin foil mask sealed between the face plate-funnel junction, with the mask projecting beyond the envelope periphery. However, there is also disclosed the sealing of a foil mask directly to the bulb. The foil is said to have a thermal coefficient of expansion greater than the glass to which it is attached. A flat faceplate has a skirt terminating in a seal land; the depth of the skirt is said to determine the Q-distance. In another disclosure, the mask is shown in attachment to a continuous internal edge depending from the faceplate. A funnel is also shown which has an internal edge for mask attachment.

Other examples of the prior art practice of utilizing a tensioned grid-type structure in a cathode ray tube environment are described in the following U.S. Pat. Nos.: 1,163,495 (6.B.); 2,761,990; 2,842,696; 2,905,845; 3,440,469; 3,489,966; 3,638,013; 3,719,848; 3,873,874 and 4,495,473.

On the other hand, a color cathode ray tube employing a planar tensed foil type shadow mask is described and claimed in referent co-pending application Ser. No. 538,003 filed Sept. 30, 1983 in the name of Kazimir Palac. Additionally, a color cathode ray tube employing a planar foil type mask in conjunction with a flat faceplate is described and claimed in referent co-pending application Ser. No. 538,001, also filed on Sept. 30, 1983 in the name of Kazimir Palac.

Finally, and by way of emphasizing the extent to which the invention to be described departs from the prior art, attention is directed to U.S. Pat. No. 3,898,508 which shows and describes a faceplate and shadow mask (untensed) assembly representative of current practice.

OBJECTS OF THE INVENTION

Accordingly, it is a general object of the invention to provide an improved color cathode ray tube color selection electrode apparatus for use in a color cathode ray tube.

It is also an object of the invention to provide an improved indexing arrangement for use with the aforesaid color selection electrode apparatus.

It is a further object of the invention to provide a color television picture tube which, in utilizing the improved color selection electrode apparatus and indexing arrangement, offers significant economic advantages over prior art tubes.

It is also an object of the invention to provide a method of manufacturing a color television cathode ray tube in utilizing the improved color selection electrode apparatus and indexing arrangement.

It is still another object of the invention to provide a tensed color selection electrode apparatus which is readily photoscreened.

Figure 2:
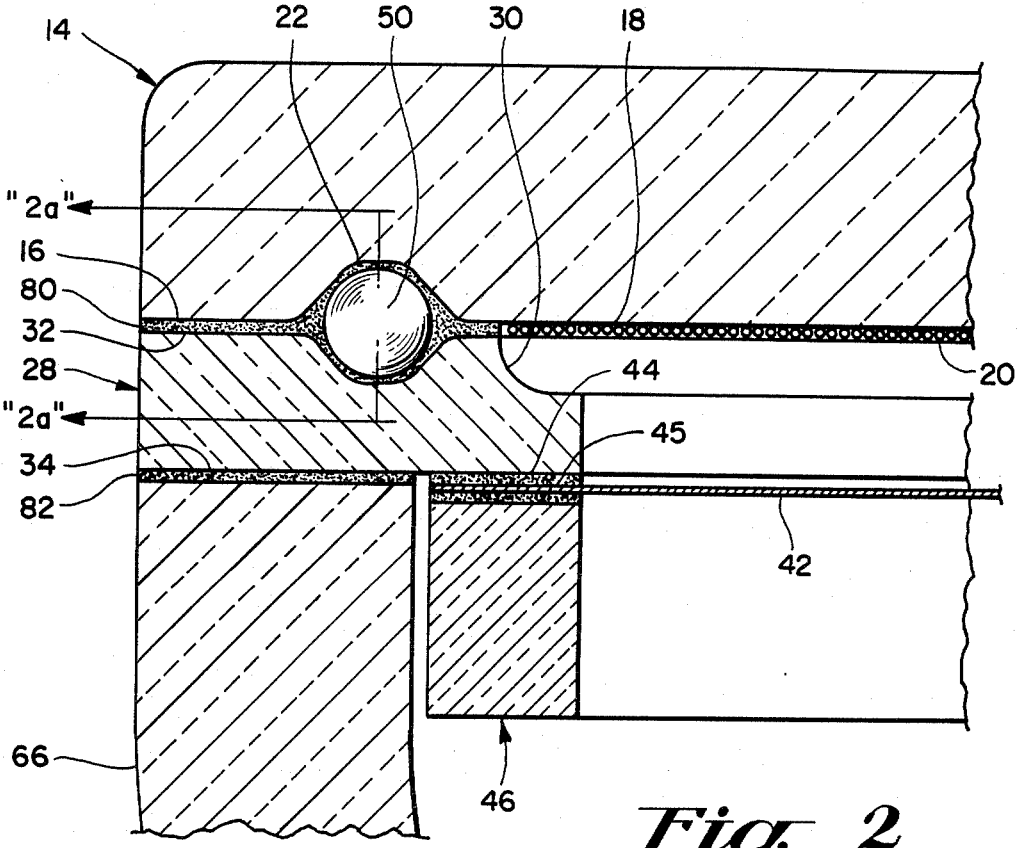
FIG. 2 is a sectional view of an assembled color cathode ray tube, as taken along line 2—2 in FIG. 1.
Figure 3:
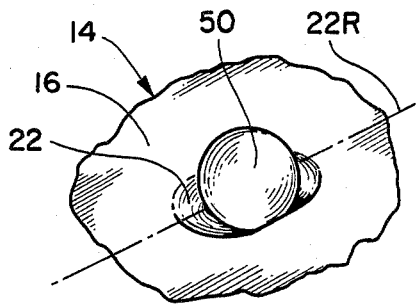
Figure 4:
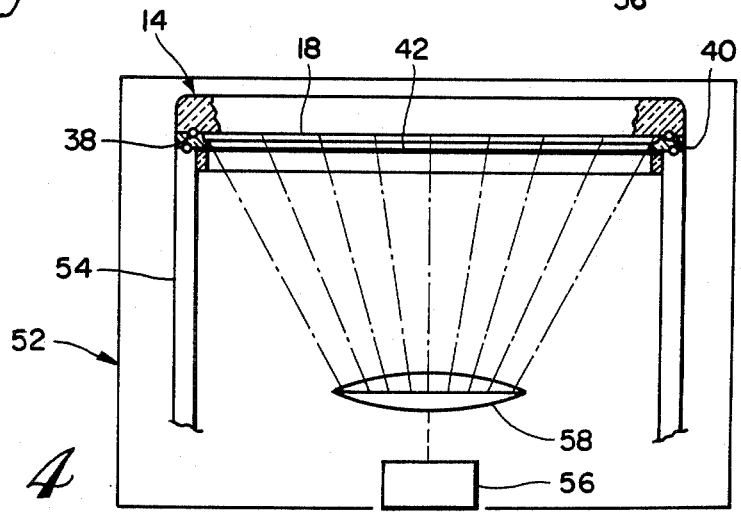

FIG. *2a* is a sectional view taken along lines *2a—2a* in FIG. 2, in which elements of the mask indexing arrangement are detailed;

FIG. 3 is a perspective view depicting the cooperative interaction of two elements of a registration affording and indexing arrangement; and FIG. 4 is a schematic representation of a lighthouse arrangement utilizable for screening a cathode ray tube face panel in accordance with the invention.

DESCRIPTION OF A PREFERRED EMBODIMENT

Figure 1:
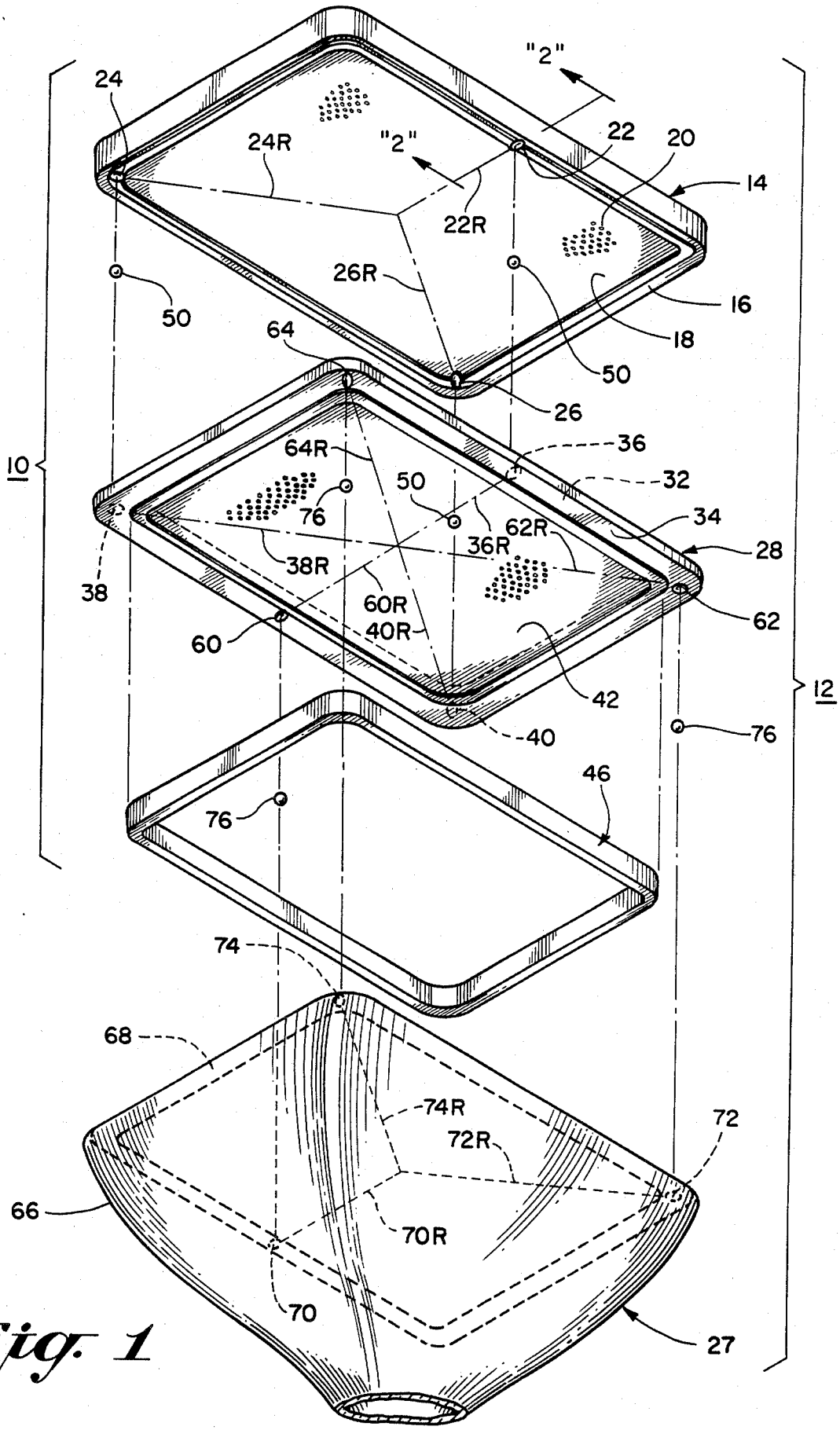
FIG. 1 is an exploded view, in perspective, of the principal components of a color cathode ray tube embodying the invention.

The apparatus 10, constructed in accordance with a preferred embodiment of the invention and shown in FIG. 1, is employable in forming a patterned screen of phosphor deposits upon a substrate. Apparatus 10 is thereafter utilizable as a constituent of a color television cathode ray tube 12. Apparatus 10 and tube 12 are depicted in a perspective exploded format as an aid in visualizing the inventive concept.

More particularly, apparatus 10 comprises a flat, substantially rectangular, glass panel 14 formed of a material having a predetermined temperature coefficient of expansion and comprising a sealing land 16 that circumscribes a target area 18. This target area serves as a substrate for receiving a patterned screen 20 of luminescent primary color elemental phosphor deposits, see FIG. 2, which may be arranged in triads of red, green, and blue phosphor dots.

To facilitate its role in screen forming, face panel 14 is provided with registration affording means comprising means defining a first plurality of cavities 22, 24, 26; in a preferred execution they constitute three holes of predetermined depth with each presenting an oval entrance that affords each cavity an elongated portion, see FIG. 3, that effectively provides the cavity with a foreshortened V-sided runway, see in particular FIG. *2a*.

The cavities are formed at selected locations upon the target side of panel 14, specifically upon sealing land 16. It is of particular significance that the elongated portion of each cavity be aligned along one of radials 22R, 24R, 26R extending from the geometric center of panel 14 and that the cavities do not extend completely across sealing land 16 to the "outside". This construction is imperative, and it applies to any subsequently described cavities, in order to avoid a direct communication across the sealing land which could compromise vacuum integrity once apparatus 10 has been frit sealed to a funnel 27 to form a constituent of a cathode ray tube. Moreover, it is preferred that one of the cavities, 22, be located upon the minor axis of panel 14 while cavities 24 and 26 be located at those corners of the panel across from cavity 22. Additional details respecting the registration affording cavities will be given at such time as the indexing means associated therewith are introduced.

Apparatus 10 further comprises a frame 28 defining a central opening 30 dimensioned to enclose target area 18 of panel 14, see FIG. 2. Frame 28 is formed of a material having a temperature coefficient of expansion approximating that of panel 14, for example, glass or a ceramic of compatible coefficient of expansion. Frame 28 comprises first and second substantially flat, spaced apart, parallel surfaces, 32, 34, respectively. As will be seen, surfaces 32 and 34 ultimately serve as sealing lands. Frame 28 also includes registration affording means comprising means defining a second like plurality of cavities 36, 38, 40 formed at selected locations on surface 32 of the frame. These cavities are depicted in broken line construction in FIG. 1 since they are on that surface (32) of frame 28 that confronts face panel sealing land 16. Cavities 36, 38, 40, while of a predetermined different depth than that of cavities 22, 24, 26, adopt a similar profile in that each of the former likewise presents an oval entrance constituting an elongated portion aligned along a respective radial 36R, 38R, and 40R extending from the geometric center of frame 28. Thus, cavities 36, 38, and 40 also establish foreshortened V-sided runways which are disposed in a confronting, and aligned relation, to their respective counterparts 22, 24, and 26 respectively, on panel sealing land 16. In fact, cavities 36, 38, and 40 are geometrically similar to cavities 22, 24, and 26, and differ only in depth, the latter cavities are deeper, see FIG. 2 or *2a*.

As depicted in FIG. 1, the plurality of panel cavities and the plurality of frame cavities are arranged so that, collectively, the axes of the elongated portions of the panel cavities exhibit substantially the same radial geometry as that collectively exhibited by the axes of the elongated portions of the frame cavities.

Apparatus 10 further comprises a color selection electrode, or shadow mask, in the form of a tensed planar foil 42 which has a predetermined pattern of apertures which can be triads of minute circular holes, which pattern, of course, corresponds to the pattern of screen 20 on face panel 14. Foil 42 has a temperature coefficient of expansion which is greater than that of frame 28. Thus, foil 42 can be formed from cold rolled steel which is utilizable with a glass or ceramic frame. The peripheral portion of foil 42 is bonded to an assigned inner area 44 of frame surface 34 by a bead of frit 45, a devitrifying glass adhesive employed in fabricating cathode ray tubes. As will be seen, frit 45 has a second role as a bonding agent. The manner in which a foil can be tensed and frit bonded to a glass or ceramic frame is fully described in co-pending patent application, Ser. No. 538,001, filed Sept. 30, 1983 in the name of Kazimir Palac.

In order to neutralize any bending or flexing moment applied to frame 28, by virtue of the tension forces in foil 42, a centrally apertured stabilizing, or stiffening, member 46, in the form of a rectangular ring having a predetermined axial thickness and formed of a material having a temperature coefficient of expansion compatible with that of frame 28 is bonded to the frame. Ring 46 has an overall span such that it does not extend beyond the foil bonding area 44 on frame surface 34 and it is also bonded to frame surface area 44. Preferably, at the same time the peripheral portion of foil 42 is bonded to area 44, stabilizing ring 46 is bonded to area 44 and by the same application of frit 45 so that foil 42 is sandwiched therebetween. This construction for frame 28 and foil 42, which affords a complete enclosure of the foil within funnel 27, is described and claimed in copending application Ser. No. 572,089 filed concurrently herewith in the names of William Rowe et al.

Figure 2A:
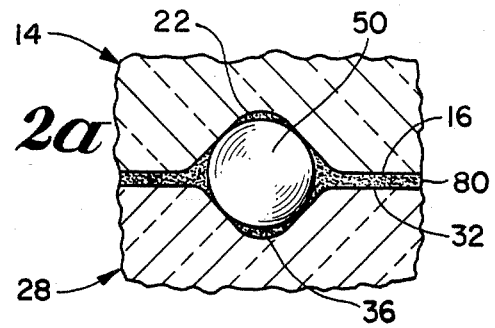

As can be appreciated, a precise and, repeatable kinematic registration between foil frame 28 and face panel 14 is essential in order to utilize foil 42 as a stencil in screening the pattern of elemental phosphor deposits upon target surface 18 of the panel. Accordingly, to accomplish the aforesaid kinematic registration, there is provided indexing means comprising a similar plurality (three) of spherical elements 50 individually receivable, or seated, between an assigned one of the panel cavities and an adjacent, oppositely disposed confronting one of the frame cavities. More particularly, elements 50 comprise balls formed of an alloy composition, the coefficient of expansion of which is compatible with the envelope glass since they will ultimately be frit sealed, in situ, when tube 12 is assembled. A glass sealable metal alloy suitable for this purpose is available from Carpenter Technology Corporation in Reading, Pennsylvania under their designation 430TI. Insofar as dimensional tolerance specifications are concerned, each of balls 50 desirably exhibits a sphericity of ±0.000050 inches. Additionally, because the cavities are of elongated configuration, each ball is afforded limited radial freedom along the confronting V-sided runways of its assigned panel and frame cavity pair to urge and establish a precise, repeatable registration between foil 42 and target area 18 of panel 14. Additionally, the ball diameter is such as to contribute to the establishment of a predetermined Q spacing between target area 14 and foil 42. Since FIG. 2 is a section taken along panel radial 22R, the aforementioned limited radial displacement is therein readily discernible. Moreover, the manner in which the V-sided runways of confronting cavities 22 and 36 embrace ball 50 and effect a four-point contact therewith is clearly depicted in FIG. 2*a*. Specifically, when frame cavities 36, 38 and 40 each have a ball 50 inserted therein and panel 14 is mounted thereon with its cavities 22, 24 and 26 overlying and receiving an assigned ball, in other words, when the previously mentioned radial geometries of the frame and panel are disposed in an overlying near-coincident relation, the panel is urged to seek a unique transverse registration relative to the frame and, of course, foil 42. This unique registration obtains because the elongated axes of the frame cavities and those of the panel cavities are directed along substantially identical radial geometries. Thus the transverse registration is kinematic and is not dependent upon an exact positioning of any particular ball along its radial provided, of course, the ball remains within its assigned cavity.

As noted, the result of the ball and cavity cooperation is to effect a repeatable registration, as between panel target area 18 and foil 42, to facilitate screening the face panel. Prior to the actual screening operation, apparatus 10 is prepared as a subassembly comprising panel 14 and frame 28 with foil 42 and ring 46 bonded thereto.

There will now be described, in connection with FIG. 4, a process that utilizes apparatus assembly 10, in conjunction with a lighthouse 52, as a stencil to screen a pattern of primary color elementary phosphor deposits upon target surface 18 of panel 14. A known and widely used method of preparing color phosphor screens utilizes a process which has evolved from familiar photographic techniques. To this end, a slurry comprising a quantity of a primary color phosphor particles suspended in a photosensitive organic solution (pva), is applied, as a coating, to target surface 18. Frame 28 with tensed foil 42 bonded thereto is then seated upon the sidewalls 54 of lighthouse 52, which sidewalls are surmounted by any suitable indexing arrangement that will effectively maintain frame 28 immobile in a plane perpendicular to the central axis of the lighthouse. If desired, a ball and cavity arrangement of the type described above can be resorted to, in fact, such an arrangement will be described below in connection with the manner in which apparatus 10 is mated to a cathode ray tube funnel. In any event, after frame 28 is mounted atop lighthouse walls 54, a series of balls 50 are inserted between frame cavities 36, 38, 40 and confronting panel cavities 22, 24, 26, respectively, to effect a registration between frame mounted foil 42 and target area 18 of panel 14. As schematically shown in FIG. 4, lighthouse 52 is seen to comprise a source of light 56 actinic to the photosensitive coating on panel target 18. At any one instant light source 56 occupies a spatial position corresponding, in effect, to the axial position of the source of the electron beam that will subsequently excite the phosphor deposits to be created. Thereafter, as in the ordinary practice, the slurry coating is exposed to actinic light rays that pass through a conventional beam trajectory compensating lens 58 before encountering the apertures in foil 42. The light transmitted through the foil, or mask, then creates a latent image of the mask's aperture pattern on the coated faceplate.

The purpose, of course, for introducing lens 58 between the light source and the stenciling foil is to compensate for that fact that the trajectory of an electron beam under deflection differs from the path of a light ray originating from the same point source as the electron beam.

Accordingly, after the initial exposure through lens 58, panel 14 is removed and the target area is washed. By way of example, in a positive resist, positive guardband system this wash will remove the exposed portion of the coating. However, it is to be appreciated that the invention is equally utilizable in a negative resist, negative guardband environment or even in the tacky-dot dusting system. In any event, the exposed coating is processed to establish upon target area 18 a pattern of elemental phosphor deposits corresponding to the aperture pattern of foil 42, as initially exposed.

The slurry coating, panel registrations, exposure and wash steps are then repeated for each of the other primary color phosphor deposits to be applied to target area 18, with the source of actinic light, of course, disposed at appropriately different positions with respect to foil 42. The resultant luminescent screen then comprises three groups of primary color phosphor deposits with each said group corresponding to the aperture pattern of foil 42. In practice, the successive repositioning of the light source, prior to exposing the target screen through the foil, is such as to effectively mimic approximate the positions of three scanning electron beams issuing from a gun mount later to be fitted to the tube. In this regard, it should be noted that the resultant luminescent screen pattern will bear a unique geometric relationship, or orientation, to the light sources and, thereby, to the electron beam axis of the subsequently fitted electron gun mount.

Referring back to FIG. 1, attention is redirected to foil supporting frame 28. More particularly, frame 28 includes additional registration affording means comprising means defining a third, like plurality of cavities 60, 62, and 64 of predetermined depth and each presenting an oval entrance that affords each cavity an elongated portion that provides the cavity with a fore-shortened V-sided runway. The cavities are individually formed at selected locations upon surface 34 of the frame. Again, the elongated portion of each cavity is aligned along a radial 60R, 62R, and 64R extending from the geometric center of the frame. It will be noted, that cavity 60 lies along the minor axis of frame 28 while cavities 62 and 64 are disposed in corners of the frame across from cavity 60. Note further that frame 28 is fitted with six cavities three on surface 32 and three on surface 34. It is significant that the locations of the cavities are staggered to the end that no two cavities are "back-to-back" which arrangement, of course, contributes to the integrity of frame 28.

Turning now to funnel 27, that component is shown to be characterized by a bell portion 66 comprising a sealing land 68, which is identified by a broken construction line since it is hidden in the FIG. 1 perspective view. Sealing land 68 is symmetrically disposed relative to the geometric center of bell portion 66.

Funnel 27 also includes registration affording means comprising means defining a fourth, like plurality of cavities 70, 72, 74, of predetermined depth and each presenting an oval entrance that affords each cavity an elongated portion that provides the cavity with a fore-shortened V-sided runway. The cavities are individually formed at selected locations upon bell portion sealing land 68. Again, as typical of all registration affording cavities described herein, the elongated portion of each of cavities 70, 72, and 74 is aligned along a respective one of radials 70R, 72R, 74R, extending from the geometric center of the bell portion 66.

Indexing means comprising a plurality of spherical elements 76 are individually receivable between an assigned one of the cavities formed on frame surface 34 and an adjacent oppositely disposed confronting one of the cavities formed on bell portion sealing land 68. Each of spherical elements 76, can adopt the same construction as previously described balls 50 and is of such diameter as to be afforded limited radial displacement along the elongated portion of its assigned frame and sealing land cavities so as to establish the geometric center of bell portion 66 in coincidence with the geometric center of frame 28. The manner in which the cavities frame 60, 62, 64 cooperate with respective bell portion cavities 70, 72, 74 respectively to receive an assigned one of balls 76, 78, 80 is readily discernible from the exploded view of FIG. 1. Moreover, it will be appreciated that the manner in which the funnel sealing land cavities, in conjunction with balls 76, cooperate with the cavities on frame surface 34 is identical to the manner in which the panel cavities 22, 24, 26, balls 50 and frame cavities 36, 38, 40 cooperate. This cooperation has been described above and is graphically illustrated in FIGS. 2 and 2*a*.

In the final assembly of cathode ray tube 12, sealing land 16 of panel 14 is bonded to frame surface 32 while frame surface 34 is bonded to funnel sealing land 68. The particular bonding agent is not critical, however, it is comtemplated that, in each instance, resort may be had to beads of frit 80, 82 for bonding panel 14 to frame surface 32 and for bonding frame surface 34 to funnel sealing land 68, respectively. As in the case with the frit bead 45 employed to bond foil 42 to frame 28, frit beads 80, 82 can also constitute a devitrifying glass cement of the type commonly employed in fabricating cathode ray tubes. In each instance, the frit to be employed can be a low temperature solder glass material which is available from Owens-Illinois, Inc. under their designation CV-130.

Insofar as effecting a registration between panel 14 and frame 28 and between frame 28 and funnel 27 is concerned, it is paramount that friction be substantially eliminated in the unions therebetween during the frit sealing operation. Specifically at the onset of that operation, and insofar as one of the aforesaid unions is concerned, a bead of frit is applied to face panel sealing land 16, or to surface 32 of frame 28. A series of balls 50 will be occupying confronting ones of panel and frame cavities so that the balls will be nested in frit material. Thereafter, at the proper elevated temperature, the frit devitrifies (liquefies) to afford each ball the opportunity for rolling contact within its assigned confronting cavities.

Obviously, friction elimination in the second of the aforesaid unions is achieved in like fashion. That is, after a bead of frit is applied to frame surface 34, or to bell portion sealing land 68, the series of balls 50 occupying confronting ones of frame and sealing land cavities will also be nested in frit material. Again at the proper elevated temperature the frit devitrifies and each of these balls is also availed of the opportunity for rolling contact within its assigned pair of cavities. Of course, in practice, both unions would be effected in one operation.

It is of consequence to note that, during the above described frit sealing operation, there is the possibility of a differential expansion occurring as respects components e.g., panel and foil, that originally were in registration. However, since the nature of this misregistration would be radial about the geometric center of the components, the effect of this misregistration in the assembled tube can be readily accommodated by a yoke adjustment.

While a preference has been indicated for forming confronting cavities to different depths, it is appreciated that confronting series of cavities, e.g. cavities 22, 24, 26 and 36, 38, 40 can be of substantially the same depth without departing from the spirit of the invention, so long as the diameter of spherical elements assigned to the confronting series of cavities is such as to maintain, in this instance, panel 14 and frame surface 32 in a spaced-apart relation.

While particular embodiments of the invention have been shown and described, it will be obvious to those skilled in the art that changes and modifications may be made without departing from the invention in its broader aspects, and, therefore, the aim of the appended claims is to cover all such changes and modifications as fall within the true spirit and scope of the invention.

I claim:

1. In a color cathode ray tube, the apparatus comprising:

a glass panel having a patterned screen of luminescent primary color elemental phosphor deposits, said panel further including registration-affording means defining a first plurality of cavities, each cavity comprising an elongated, substantially radially aligned portion formed at a selected peripheral location upon the screen side of said panel;

a frame defining a central opening dimensioned to enclose said screen of said panel and comprising first and second spaced-apart surfaces;

said frame further including registration-affording means defining a second like plurality of cavities, each cavity also comprising an elongated, substantially radially aligned portion formed at a selected peripheral location upon said first surface of said frame, said plurality of panel cavities and said plurality of frame cavities being arranged so that, collectively, the axes if said elongated portions of said panel caviaties exhibit substantially the same radial geometry as that collectively exhibited by the axes of said elongated portions of said frame cavities;

a color selection electrode comprising a tensed foil having a predetermined pattern of apertures, a peripheral portion thereof being bonded to said second surface of said frame; and indexing means comprising a like plurality of spherical elements individually received between an assigned one of said panel cavities and an adjacent, oppositely disposed confronting one of said frame cavities, so that, when said panel and frame cavities are disposed in an overlying near coincident relation, said spherical elements establish a precise repeatable registration between said frame and said panel, and thus between said foil apertures and said screen.

2. Apparatus as set forth in claim 1 in which said spherical elements comprise balls having a sphericity approximating ±0.000050 in.

3. Apparatus as set forth in claim 1 in which each said recited plurality consists of three.

4. Apparatus as set forth in claim 1 in which at least one of said panel cavity locations is disposed upon the minor axis of said panel and in which at least one of said frame cavity locations is disposed upon the minor axis of said frame.

5. Apparatus as set forth in claim 1 in which said panel further comprises a sealing land that circumscribes said target area and said panel cavity locations are arrayed along said sealing land.

6. Apparatus as set forth in claim 1 in which said panel cavities are characterized by a predetermined depth and said frame cavities are characterized by a predetermined different depth.

7. Apparatus as set forth in claim 6 in which said panel cavities are deeper than said confronting frame cavities.

8. Apparatus as set forth in claim 1 in which said spherical elements are formed of an alloy composition having a coefficient of expansion that is compatible with that of said panel and frame.

9. A color cathode ray tube comprising:

a funnel having a sealing land;

a flat glass panel having a pattern of luminescent primary color elemental phosphor deposits thereon, said panel further including a sealing land circumscribing said target area, and registration affording means comprising means defining a first plurality of cavities each comprising an elongated portion, individually formed at selected locations upon the target area side of said panel, with each said elongated portion aligned along a radial extending from the geometric center of said panel;

a color selection electrode assembly affording selection of said phosphor deposits by a scanning beam of electrons comprising:

a frame defining a central opening dimensioned to enclose said target area of said panel, said frame comprising first and second substantially flat, spaced-apart parallel surfaces, said frame further including registration affording means comprising means defining a second, like plurality of cavities, each also comprising an elongated portion, individually formed at selected locations upon said first surface of said frame with each said elongated portion aligned along a radial extending from the geometric center of said frame, said plurality of panel cavities and said plurality of frame cavities being arranged so that, collectively, the axes of said elongated portions of said panel cavities exhibit substantially the same radial geometry as that collectively exhibited by the axes of said elongated portions of said frame cavities;

a color selection electrode comprising a planar tensed foil having a predetermined pattern of apertures, the peripheral portion thereof being bonded to said second surface of said frame;

indexing means comprising a similar plurality of spherical elements individually receivable between an assigned one of said panel cavities and an adjacent, oppositely disposed confronting one of said frame cavities, so that, when said panel and frame cavity radial geometries are disposed in an overlying near coincident relation, said spherical elements are caused to urge a precise transverse registration between said foil and said target area;

means for bonding said panel sealing land to said first surface of said frame with said spherical elements in situ; and means for bonding said funnel sealing land to said second surface of said frame.

10. A color cathode ray tube as set forth in claim 9 in which said spherical elements are of such diameter as to establish a predetermined Q spacing between said panel target area and said foil.

11. A color cathode ray tube comprising:

a flat glass panel comprising a target area having a pattern of luminescent primary color elemental phosphor deposits thereon, said panel further including a sealing land circumscribing said target area, and registration affording means comprising means defining a first plurality of cavities, each comprising an elongated portion, individually formed at selected locations upon said sealing land of said panel, with each said elongated portion aligned along a radial extending from the geometric center of said panel;

a color selection electrode assembly affording selection of said phosphor deposits by a scanning beam of electrons comprising:

a frame defining a central opening diminsioned to enclose said target area of said panel, said frame comprising first and second substantially flat, spaced-apart parallel surfaces, said frame including registration affording means comprising means defining a second, like plurality of cavities, each also comprising an elongated portion, individually formed at selected locations upon said first surface of said frame with each said elongated portion aligned along a radial extending from the geometric center of said frame, said first plurality of panel cavities and said second plurality of frame cavities being arranged so that, collectively, the axes of said elongated portions of said panel cavities exhibit substantially the same radial geometry as that collectively exhibited by the axes of said elongated portions of said frame cavities;

said frame further including additional registration affording means comprising means defining a third, like plurality of cavities, each also comprising an elongated portion, individually formed at selected locations upon said second surface of said frame with each said elongated portion aligned along a radial extending from the geometric center of said frame;

a color selection electrode comprising a planar tensed foil having a predetermined pattern of apertures, the peripheral portion thereof being bonded to an assigned area of said second surface of said frame;

a funnel having a bell portion comprising a sealing land symmetrically disposed relative to the geometric center of said bell portion;

said funnel including registration affording means comprising means defining a fourth, like plurality of cavities, each also comprising an elongated portion, individually formed at selected locations upon said bell portion sealing land with each said elongated portion aligned along a radial extending from said geometric center of said bell portion;

indexing means comprising a first plurality of spherical elements individually receivable between an assigned one of said panel cavities and an adjacent, oppositely disposed confronting one of said cavities formed on said first surface of said frame, so that when said panel and frame cavity radial geometries are disposed in an overlying near coincident relation, said first plurality of spherical elements are caused to urge and establish a precise transverse registration between said foil and said target area;

a second, similar, plurality of spherical elements individually receivable between an assigned one of said cavities formed on said second surface of said frame and an adjacent oppositely disposed confronting one of said cavities formed on said bell portion sealing land, so that when said frame and said bell portion cavity radial geometries are disposed in an overlying near coincident relation, said second plurality of spherical elements are caused to establish a precise transverse registration between said frame and said bell portion;

means for frit sealing said panel sealing land to said first surface of said frame with said first plurality of spherical elements in situ; and means for frit sealing said bell portion sealing land to said second surface of said frame with said second plurality of spherical elements in situ.

12. A color cathode ray tube as set forth in claim 11 in which each cavity of said first and third pluralities of cavities is characterized by a predetermined depth and in which each cavity of said second and fourth pluralities of cavities is characterized by a predetermined different depth.

13. A color cathode ray tube as set forth in claim 12 in which said cavities of said predetermined depth are deeper than said cavities of predetermined different depth.

14. A method of utilizing a color selection apparatus as a stencil for forming a patterned screen of luminescent primary color elemental phosphor deposits upon a substrate utilizable as a constituent of a color cathode ray tube, said apparatus comprising:

a flat glass panel comprising a target area serviceable as a substrate for receiving said screen, said panel further including registration affording means comprising means defining a first plurality of cavities each comprising an elongated portion and individually formed at selected locations upon the target area side of said panel, with each said elongated portion aligned along a radial extending from the geometric center of said panel;

a frame defining a central opening dimensioned to enclose said target area of said panel, said frame comprising first and second substantially flat, spaced-apart parallel surfaces, and registration affording means comprising means defining a second, like plurality of cavities, each also comprising an elongated portion and individually formed at selected locations upon said first surface of said frame with each said elongated portion aligned along a radial extending from the geometric center of said frame;

a tensed foil having a predetermined pattern of apertures, bonded to an assigned area of said second surface of said frame; and indexing means comprising a similar plurality of spherical elements individually receivable between an assigned one of said panel cavities and an adjacent, oppositely disposed confronting one of aid frame cavities;

said method comprising the following steps:

(a) applying a photosensitive coating to said target area of said panel;

(b) registering said frame with said panel to enable said foil to serve as a stencil by inserting said plurality of spherical elements individually between an assigned one of said frame cavities and the adjacent oppositely disposed confronting one of said panel cavities to enable said foil to seek and effect a precise, repeatable registration with said target area;

(c) selectively locating a source of actinic light rays to expose said photosensitive coating through the pattern of apertures in said foil, said light source being so located as to effectively approximate the position to be occupied by the electron beam subsequently employed to scan the to be developed pattern of phosphor deposits;

(d) removing said frame;

(e) retaining said spherical elements in one of said panel or said frame plurality of cavities;

(f) processing said exposed coating to establish a pattern of elemental phosphor deposits upon said panel target area corresponding to the aperture pattern of said tensed foil, and (g) repeating said steps (a) through (f) each pattern of elemental phosphor deposits to be established.

15. In a color cathode ray tube, the apparatus comprising:

an envelope section having a peripheral sealing area with a plurality of first substantially radially oriented registration-affording V-grooves selectively located thereon;

a faceplate comprising a target surface having a pattern of luminescent phosphor areas deposited thereon and a sealing area circumscribing said target surface and geometrically matching said envelope section sealing area, said faceplate sealing area having a like plurality of second substantially radially oriented registration-affording V-grooves selectively located in alignment with said first V-grooves on said envelope section;

a foil color selection electrode supported in tension by said envelope section and having a pattern of color selection apertures related to said pattern of phosphor areas; and a like plurality of free-floating spherical balls disposed between the mated first and second registration-affording V-grooves of said faceplate and said envelope section for establishing precise registration between said faceplate and said envelope section.

16. The apparatus defined by claim 15 including a hardenable liquid cement means disposed between said envelope section sealing area and said faceplate sealing area for bonding said envelope section to said faceplate with said balls captured between said first and second registration-affording V-grooves, said balls moving freely in said V-grooves to effect said registered mating when said cement means is in a liquid state, and being captivated therebetween when said cement hardens.

17. For use in a color cathode ray tube having a face panel for receiving a patterned screen of luminescent primary color elemental phosphor deposits, the apparatus comprising:

a tube envelope section supporting in tension a shadow mask confronting said patterned screen and defining a central opening dimensioned to enclose said screen;

indexing means for indexing said screen to said mask, including:

means located beyong the periphery of said screen defining a first plurality of cavities presenting an oval entrance;

means located in the periphery of said frame defining a second, like plurality of geometrically similar cavities disposed in confronting and aligned relationship to said first plurality of cavities;

ball means individually seated between assigned ones of said first plurality of said cavities, and in adjacent, oppositely disposed confrontation to ones of said second plurality of cavities such that said indexing means urge and establish a precise, repeatable kinematic registration between said screen and said mask.

18. The means for indexing said screen to said mask according to claim 17 wherein the configuration of each of said cavities is a foreshortened V-sided runway.

19. The means for indexing according to claim 17 wherein the elongated portion of each cavity is aligned with a radial extending from the geometric center of the screen.

20. The means for indexing according to claim 17 wherein said cavities do not extend to the external surface of the tube envelope.

21. The means of indexing according to claim 17 wherein said balls are of an alloy composition, with a coefficient of thermal expansion compatible with the composition of said screen and said frame.

22. The means of indexing according to claim 17 wherein each of said balls is afforded limited radial freedom along said confronting V-sided runways of its assigned screen or frame cavity pair to urge and establish a precise registration between said screen and said mask.

23. The means of indexing according to claim 17 wherein each of said balls is of such diameter as to contribute to the establishment of a predetermined spacing between said screen and said mask.

24. The means of indexing according to claim 23 wherein said predetermined spacing includes spacing about said balls to permit the application of devitrifying frit which, when devitrified at an elevated temperature, affords each of said balls the opportunity for rolling contact within its assigned confronting cavity.

* * * * *